US005659148A

United States Patent [19]

Isgen

[11] Patent Number: 5,659,148

[45] Date of Patent: Aug. 19, 1997

[54] TEMPERATURE DETECTOR FOR A GUN BARREL

[75] Inventor: Helmut Isgen, Willich, Germany

[73] Assignee: Rheinmetall Industrie GmbH, Ratingen, Germany

[21] Appl. No.: 531,316

[22] Filed: Sep. 20, 1995

[30] Foreign Application Priority Data

Sep. 21, 1994 [DE] Germany ..... 44 33 627.6

[51] Int. Cl.[6] ..... F41A 21/00

[52] U.S. Cl. ..... 89/14.05; 42/76.01

[58] Field of Search ..... 89/14.05, 1.1; 42/1.01, 76.01, 106

[56] References Cited

U.S. PATENT DOCUMENTS 2,829,185 4/1958 Macatician et al. ..... 136/4
3,618,455 11/1971 Plumer et al. ..... 89/132
4,342,961 8/1982 Zimmermann et al. ..... 324/179
4,811,666 3/1989 Luffy ..... 102/501
5,347,909 9/1994 Kozlik ..... 89/40.01
5,444,219 8/1995 Kelly ..... 219/505

*Primary Examiner*—J. Woodrow Eldred
*Attorney, Agent, or Firm*—Spencer & Frank

[57] ABSTRACT

A gun includes a barrel which has a barrel wall; a barrel chamber defined by the barrel wall; and a recess provided in the barrel wall in the zone of the barrel chamber. There is further provided a chamber temperature sensing assembly which includes a temperature sensor disposed in the recess for providing an electric signal representing temperatures of the barrel chamber; an electronic evaluating circuit; and an electric conductor connecting the temperature sensor with the electronic evaluating circuit. The electric conductor has lead wire portions which are situated in the recess of the barrel wall and which, together with the temperature sensor, are embedded in a casting mass accommodated in the recess.

10 Claims, 2 Drawing Sheets

TEMPERATURE DETECTOR FOR A GUN BARREL

CROSS REFERENCE TO RELATED APPLICATION

This application claims the priority of German Application No. P 44 33 627.6 filed Sep. 21, 1994, which is incorporated herein by reference.

BACKGROUND OF THE INVENTION

This invention relates to a gun barrel having a temperature sensor disposed in a recess of the barrel wall for monitoring the chamber temperature.

A gun of the above-outlined type is disclosed in U.S. Pat. No. 3,618,455. In the construction disclosed therein the temperature sensor is placed in a blind bore of the barrel wall in the region of the chamber. The temperature sensor (for example, a mercury sensor or a bimetal element) expands as the temperature increases. When, after multiple firings, the temperature in the chamber reaches a value which may lead to a self-ignition of the charge ("cook-off" temperature), the temperature sensor has expanded to such an extent that it displaces the firing device into its safe (locked) position with the aid of a piston-and-rod assembly also disposed in the blind bore.

It is a disadvantage of an arrangement of the above-outlined type that the installation of the temperature sensor into the blind bore together with the piston-and-rod assembly involves a substantial technological outlay. It is a further drawback that the installed accessories have to be serviced at regular intervals. It is a further disadvantage that the relatively large blind bore leads to an undesired weakening of the barrel, leading to a shortening of its service life.

SUMMARY OF THE INVENTION

It is an object of the invention to provide an improved gun barrel of the above-outlined type in which the temperature sensor operates in a disturbance-free manner, and further wherein the temperature sensor substantially does not require any servicing and may be installed in the barrel in a simple manner.

This object and others to become apparent as the specification progresses, are accomplished by the invention, according to which, briefly stated, the gun includes a barrel which has a barrel wall; a barrel chamber defined by the barrel wall; and a recess provided in the barrel wall in the zone of the barrel chamber. There is further provided a chamber temperature sensing assembly which includes a temperature sensor disposed in the recess for providing an electric signal representing temperatures of the barrel chamber; an electronic evaluating circuit; and an electric conductor connecting the temperature sensor with the electronic evaluating circuit. The electric conductor has lead wire portions which are situated in the recess of the barrel wall and which, together with the temperature sensor, are embedded in a casting mass accommodated in the recess.

The invention is based essentially on the principle that instead of a temperature sensor which is arranged in the barrel wall and which, by virtue of its temperature-dependent expansion directly mechanically operates the firing device, a sensor assembly is provided whose electrical properties are measured and, by means of an electronic evaluating circuit, converted to corresponding setting signals which serve, for example, as visual indicators for actuating the firing device. Such a gun has the significant advantage that the required recesses in the barrel wall may have only a very small diameter and therefore only negligibly weaken the barrel wall and thus do not adversely affect the service life of the gun. In addition, such a sensor needs practically no servicing since no soiling or damaging of the sensors may occur, inasmuch as the sensor is embedded in an encasing mass.

In order to avoid a self-ignition of the propellant charge, the temperature sensor is disposed at the hottest location of the barrel wall.

It is within the scope of the invention to provide a plurality of sensors which are distributed in the barrel wall in the region of the chamber and to determine, from the group of measured temperature data, the maximum temperature of the chamber with the aid of the electronic evaluating circuitry.

Tests have shown that the temperature sensor is preferably positioned in the lower end of a blind bore provided in the weapon barrel. Between the inner wall of the barrel and the base of the blind bore the remaining wall thickness in large-caliber weapons should be at least 2 mm.

DESCRIPTION OF THE PREFERRED EMBODIMENT

Figure 1:
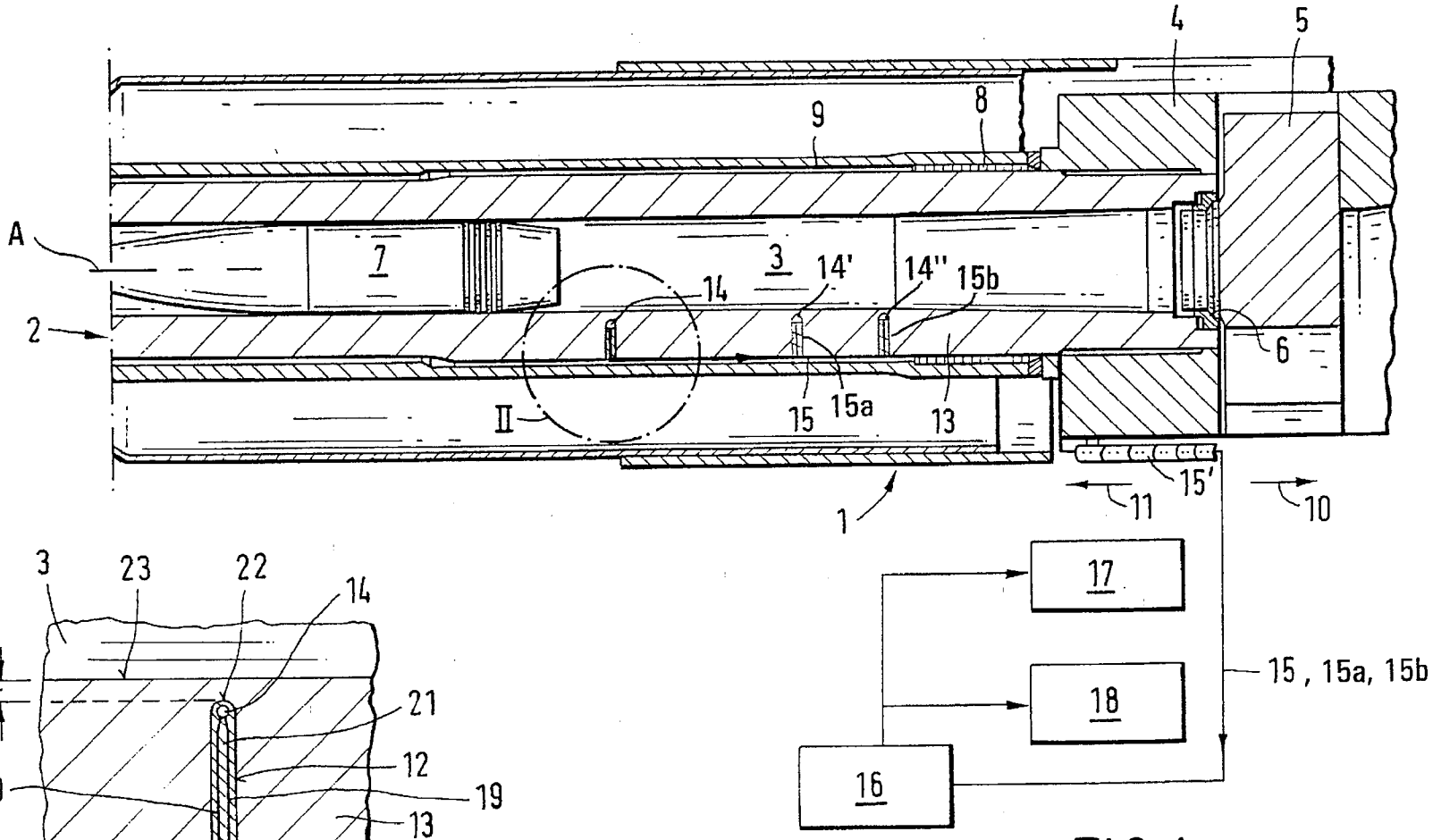
FIG. 1 is an axial sectional view of a gun barrel supported in a gun cradle and including a preferred embodiment of the invention.

FIG. 1 illustrates the construction and arrangement of a gun barrel 2 in the zone of the barrel chamber 3, forming part of an only symbolically shown gun 1. The barrel 2 which has a longitudinal barrel axis A, is, at its rearward end, connected with a breech ring 4 in which a transversely movable wedge-type breechblock 5 closes the chamber 3 together with an obturator ring 6 during firing and opens the chamber 3 for introducing a shell 7 and a non-illustrated propellant charge situated between the shell 7 and the breechblock 5.

The barrel 2 is displaceably supported in a rear barrel support 8 and a non-illustrated frontal weapon support within an elevation-adjustable cradle tube 9 for the barrel recoil (arrow 10) and the counter recoil (arrow 11).

Figure 2:
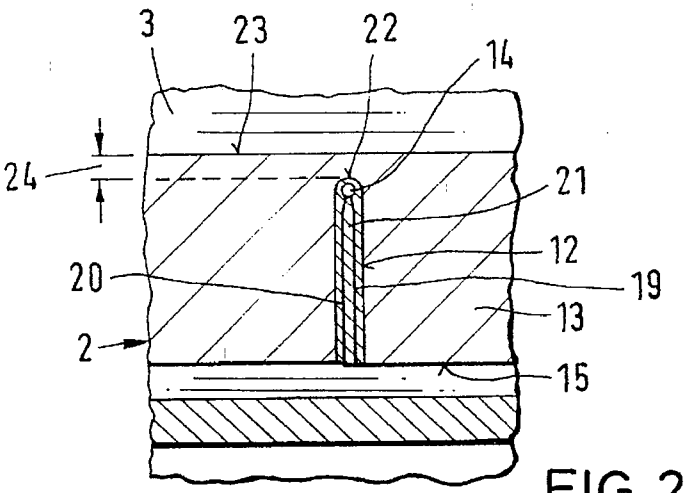
FIG. 2 is an enlarged view of the inset II shown in FIG. 1.

Also referring to FIG. 2, for a continuous monitoring of the temperature prevailing in the chamber 3, particularly upon firing, in a recess 12 of the wall 13 of the barrel 2 a temperature sensor 14 is arranged which provides signals representing the chamber temperature. The temperature sensor may be, for example, a thermoelement, a resistor-type temperature sensor or a semiconductor-type temperature sensor. The temperature sensor 14 is connected by an electrical conductor 15 with an electronic evaluating circuit 16 from which output signals are applied to a fire control computer 17 known by itself as well as a temperature indicator 18. This arrangement makes it feasible to continuously monitor and to visually indicate the barrel temperature in the region of the chamber 3 as well as to further process the temperature data in the fire control computer 17, for example, for the purpose of interrupting a firing sequence. To this end, the fire control computer 17 may include a comparator which, upon receiving a signal representing a chamber temperature that exceeds a permissible value, sends a command to a switch to prevent firing.

Figure 3:
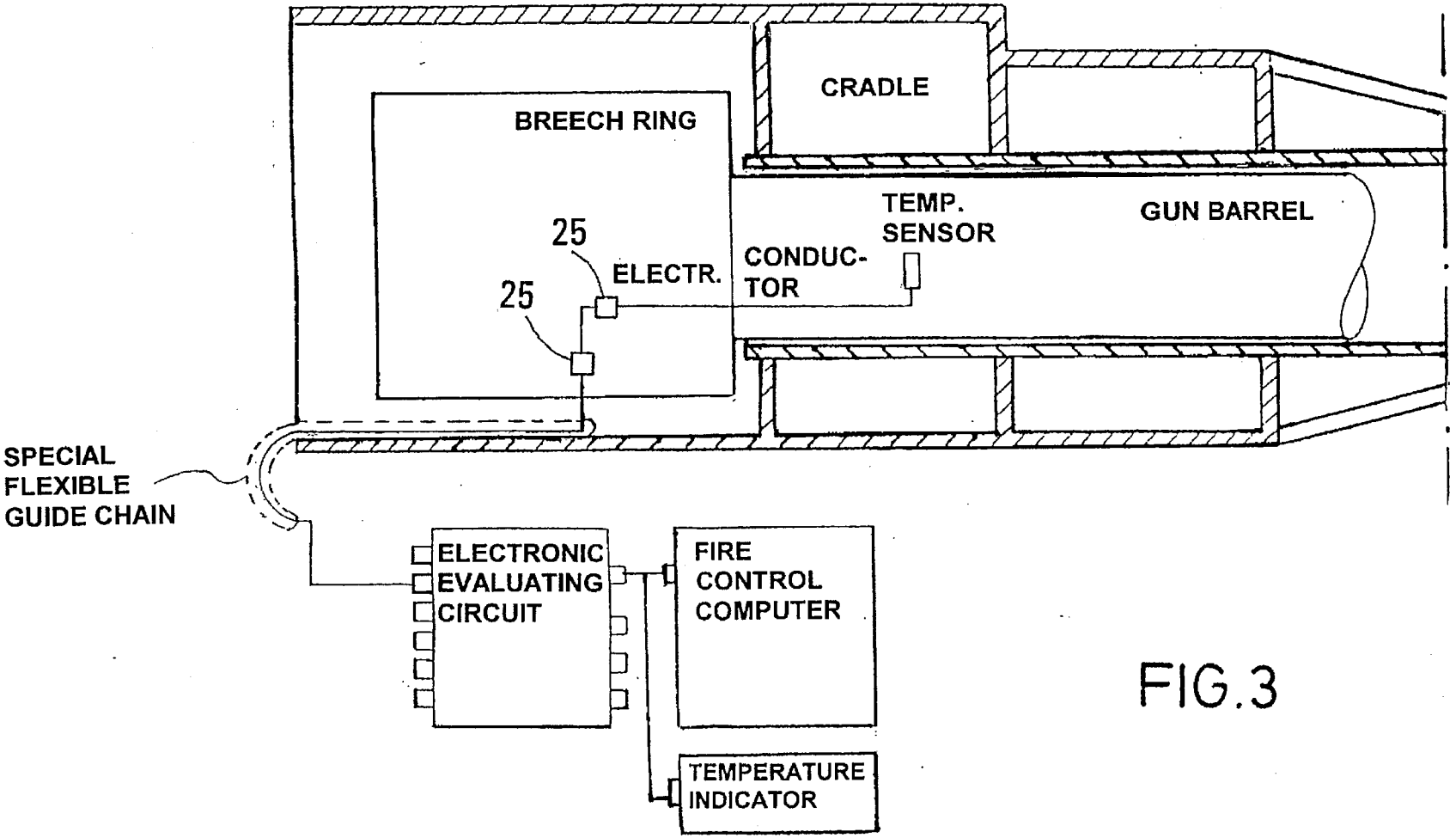
FIG. 3 shows the Temperature Sensor in the barrel, the electrical conductor on the recoil system and the flexible chain on the cradle.

It has been found advantageous to place the electric conductor 15 along the outer wall of the barrel 1 up to the region of the breech ring 4 and thereafter to connect it with terminals disposed on the non-illustrated cradle by means of a slack guide chain 15' made for example of plastic. This arrangement ensures that the electric conductor 15 remains continuous between the recoiling mass and the stationary cradle and it is in accordance to the military standards. The electronic circuit 16 is connected with the terminals on the cradle. The guide chain 15' is, at one end, secured to the recoiling mass, for example, to the breech ring 4, and is secured at its other end to the stationary cradle. By forming a loose loop of the chain 15' a rupture or damaging thereof upon recoil of the barrel is prevented. Mantling and dismantling of the electric conductor is realized with a military standard quick coupling (FIG. 3, Pos. 25).

Such a signal transmission corresponds to standard requirements and leads, in conjunction with the temperature sensor 14 and the electronic evaluating circuit 16 to a reliable temperature indication which is a precondition for a predetermined firing schedule. Stated differently, firing tasks may be determined in advance by a computer without the need to abort such tasks because, for example, the barrels attained an excessive temperature.

As seen in FIG. 2, the temperature sensor 14 as well as the two wires 19 and 20 of the electric conductor 15 are embedded (cast) in a conventional casting material 21 in the recess 12 which is constituted by a blind bore which extends from the outer barrel surface generally radially to the longitudinal barrel axis A. Between the bottom of the recess 12 and the inner wall 23 of the barrel the remaining wall thickness 24 is approximately 2 mm.

Due to the possibility of a continuous observation of the heating and cooling of the barrel 2 in the region of the chamber 3, the firing sequence and ammunition supply is controlled in accordance with the temperature course whereby an overheating of the barrel 2 is prevented and an undisturbed firing operation until reaching a critical barrel temperature is possible. Only upon reaching the "cook-off" temperature of the propellant charge is the firing operation interrupted by switching off a non-illustrated operating unit to ensure a high degree of safety of the operating personnel. Or, as noted before, by virtue of the invention, the firing schedule is, with the aid of a computer, predetermined for the purpose of processing the required firing tasks.

As illustrated in FIG. 1, it is feasible to provide additional sensors 14' and 14" disposed in respective spaced recesses in the gun barrel and connected by respective conductors 15*a*, 15*b* to the circuit 16.

It will be understood that the above description of the present invention is susceptible to various modifications, changes and adaptations, and the same are intended to be comprehended within the meaning and range of equivalents of the appended claims.

What is claimed is:

1. A gun comprising (a) a barrel including (1) a barrel wall;

(2) a barrel chamber defined by said barrel wall;

(3) a blind bore extending in said barrel wall in a zone of said barrel chamber generally radially to a longitudinal barrel axis; said blind bore having a bottom; a remaining thickness of the barrel wall between said bottom and an inner face of said barrel wall being at least 2 mm; and (b) a chamber temperature sensing assembly including (1) a temperature sensor disposed in said blind bore; said temperature sensor providing an electric signal representing temperatures of said barrel chamber;

(2) an electronic evaluating circuit;

(3) an electric conductor connecting said temperature sensor with said electronic evaluating circuit; said electric conductor having lead wire portions situated in said blind bore; and (4) a casting mass accommodated in said blind bore and embedding said temperature sensor and said lead wire portions.

2. The gun as defined in claim 1, wherein said temperature sensor is situated at a hottest location of said barrel wall.

3. The gun as defined in claim 1, further comprising a stationary gun cradle; said barrel being movable relative to said gun cradle to execute recoil and counter recoil motions; said electric conductor extending uninterrupted between said barrel and said gun cradle.

4. The gun as defined in claim 3, further comprising a slack guide chain extending between said barrel and said gun cradle; said electric conductor being supported by said guide chain.

5. The gun as defined in claim 4, wherein said guide chain is plastic.

6. The gun as defined in claim 3, further comprising a breech ring attached to an end of said barrel; said electric conductor extending along an outer face of said barrel into a zone of said breech ring.

7. The gun as defined in claim 1, wherein said temperature sensor is a thermoelement.

8. The gun as defined in claim 1, wherein said temperature sensor is a resistor-based temperature sensor.

9. The gun as defined in claim 1, wherein said temperature sensor is a semiconductor-based temperature sensor.

10. A gun comprising (a) a barrel including (1) a barrel wall;

(2) a barrel chamber defined by said barrel wall; and (3) a plurality of spaced blind bores extending in said barrel wall in a zone of said barrel chamber generally radially to a longitudinal barrel axis; each said blind bore having a bottom; a remaining thickness of the barrel wall between said bottom and an inner face of said barrel wall being at least 2 mm; and (b) a chamber temperature sensing assembly including (1) a plurality of temperature sensors disposed in respective said blind bores; said temperature sensors providing electric signals representing temperatures of said barrel chamber;

(2) an electronic evaluating circuit;

(3) electric conductors connecting said temperature sensors with said electronic evaluating circuit; said electric conductors having lead wire portions situated in said respective blind bores; and (4) a casting mass accommodated in each said blind bore and embedding said temperature sensor and said lead wire portions.

* * * * *